United States Patent [19]

Sakurai

[11] Patent Number: 4,595,274

[45] Date of Patent: Jun. 17, 1986

[54] FIXING APPARATUS

[75] Inventor: Masaaki Sakurai, Yokohama, Japan

[73] Assignee: Canon Kabushiki Kaisha, Tokyo, Japan

[21] Appl. No.: 660,327

[22] Filed: Oct. 12, 1984

[30] Foreign Application Priority Data

Oct. 14, 1983 [JP] Japan ..... 58-190930

[51] Int. Cl.[4] ..... G03G 15/20

[52] U.S. Cl. ..... 355/3 FU; 355/14 FU; 219/216

[58] Field of Search ..... 355/14 FU, 3 FU, 3 R, 355/14 R; 219/216

[56] References Cited

U.S. PATENT DOCUMENTS

| | | | |
|---|---|---|---|
| 4,045,164 | 8/1977 | Moser et al. | 355/3 FU X |
| 4,372,246 | 2/1983 | Azar et al. | 355/3 FU X |
| 4,395,109 | 7/1983 | Nakajima et al. | 355/3 FU |
| 4,470,688 | 9/1984 | Inagaki et al. | 355/3 FU |

*Primary Examiner*—A. C. Prescott

*Attorney, Agent, or Firm*—Fitzpatrick, Cella, Harper & Scinto

[57] ABSTRACT

A fixing apparatus for fixing a toner image has a heating roller and a pressure roller both with heaters, reflecting plates and covers for preventing heat radiation from the heating and pressure rollers, heat-resistant gears for transmitting a driving force to the rollers, and heat-resistant sleeves arranged between a heating roller core and the gears. Thermal efficiency of the apparatus is improved, and a clear fixed image can be obtained.

21 Claims, 6 Drawing Figures

FIXING APPARATUS

BACKGROUND OF THE INVENTION

1. Field of the Invention

The present invention relates to a fixing apparatus frequently used in an image forming apparatus such as a printer, a copying machine or a facsimile system so as to fix a developed medium on a support medium.

2. Description of the Prior Art

Most of the conventional fixing apparatuses employ a fixing system wherein a toner image formed by an image forming means in an image forming apparatus is heated and fixed on a recording medium such as paper.

In a conventional fixing apparatus of this type, a heating roller as a first rotating member is used as a fixing roller. A pressure roller is used as a second rotating member which is brought into rolling contact with the first rotating member. This fixing system is called a heating roller fixing system.

However, several problems are presented in the conventional fixing apparatus of this type. For example, the characteristics of the finally fixed medium and the image quality are not acceptable. Many factors influence these problems of the fixing apparatus, and no fixing apparatus which satisfies requirements of all such factors has been proposed.

A thermal element concerning the fixing property is described in (a) U.S. Pat. No. 3,945,726 (similar descriptions are exemplified by Japanese Patent Publication No. 35498/1979 and Japanese Utility Model Publication No. 60020/1982). According to U.S. Pat. No. 3,945,726, a heat-insulating bush is inserted between a bearing of a frame member for supporting a heating roller and the heating roller. In (b) Japanese Utility Model Desclosure No. 145061/1981, as an application example, a heat-insulating material is inserted between a drive gear and a heat roller and a heat-insulating bush is mounted in a bearing so as to prevent heat conduction to the drive gear.

However, according to the invention (a), the heat loss is excessively large, and temperatures at end portions of the heat roller become low. In the utility model (b), a decrease in temperature at the central portion of the heating roller becomes large when sheets are continuously fixed, resulting in incomplete fixing at the central portion of the heating roller, although there is no problem in case of noncontinuous sheet feeding.

Unlike the prior art described above, an arrangement has been proposed wherein a temperature profile of the heater at the end portions is increased to obtain a uniform temperature profile along the axial direction of the heating roller so as to compensate for the heat loss. However, according to this arrangememt, the heat loss at the end portions of the heating roller is increased, and thus the heating efficiency is degraded. In addition to this disadvantage, an increase in temperature occurs inside the system using this fixing apparatus. Blocking of toner in the cleaner and the developing unit occurs, plastic components are thermally deformed, and other problems also occur. The above conventional techniques have been proposed to prevent the thermal loss and improve the fixing property. The technical level is associated with exothermic properties. As described above, the fixing roller is maintained in a thermally floating state. Then, the fixing roller is not electrically grounded since electrically insulating plastic members such as the heat-insulating sleeve, the rolling bearing or the heat-insulating member are used.

In this state, when the sheet passes between the pair of fixing rollers for fixing a toner image on the sheet, the roller is highly charged upon one fixing operation, resulting in a spark or discharge.

The present inventor found that degradation in image quality after fixing was caused by discharge of charges accumulated during fixing. The present inventor studied to develop a fixing apparatus capable of maintaining the fixing level at high level and for obtaining a clear fixed image and found that an erroneous operation (jam detection disable state, paper feed error, overrunning, no restarting, temperature control failure, etc.) is caused by the spark and discharge (these are assumed to occur by a spurious signal or a high current which may be supplied to the circuit of the image forming apparatus) and that proper electronic control cannot be performed if such an erroneous operation is caused.

In another conventional fixing apparatus described in Japanese Utility Model Disclosure No. 58136/1979, a conductive brush is brought into contact with the entire surface of an insulating elastic layer as a coating of the fixing roller surface so as to prevent the sheet from being wound therearound. However, according to this arrangement, a toner or paper dust is attached to the distal end of the brush, the discharge effect is greatly decreased, and an effect of preventing the sheet from being wound around the fixing roller cannot be sufficiently obtained. In addition, the roller surface is partially charged and discharged. Under this condition, spark and discharge occur between the conductive portion in the vicinity of a contaminated leading end thereof and a charged portion on the roller surface. This phenomenon is not associated with the technical level of Japanese Utility Model Disclosure No. 58136/1979, but becomes a critical issue for the present inventor.

No conventional fixing apparatus satisfies requirements for both high-speed fixing and clear image quality after fixing.

SUMMARY OF THE INVENTION

The present invention has been made in consideration of the above situation and to improve the conventional drawbacks described above, and has as its object to provide a fixing apparatus wherein heat loss from a fixing rotating member such as a heating roller for heating a sheet, a pressure roller or a belt can be minimized to effectively use the heating source, and high image quality can be provided.

It is another object of the present invention to provide a fixing apparatus which prevents a material or medium (e.g., a toner, a resin and a capsule resin) to be fixed from being scattered, thereby providing a high quality fixing.

DESCRIPTION OF THE PREFERRED EMBODIMENT

Figure 1:
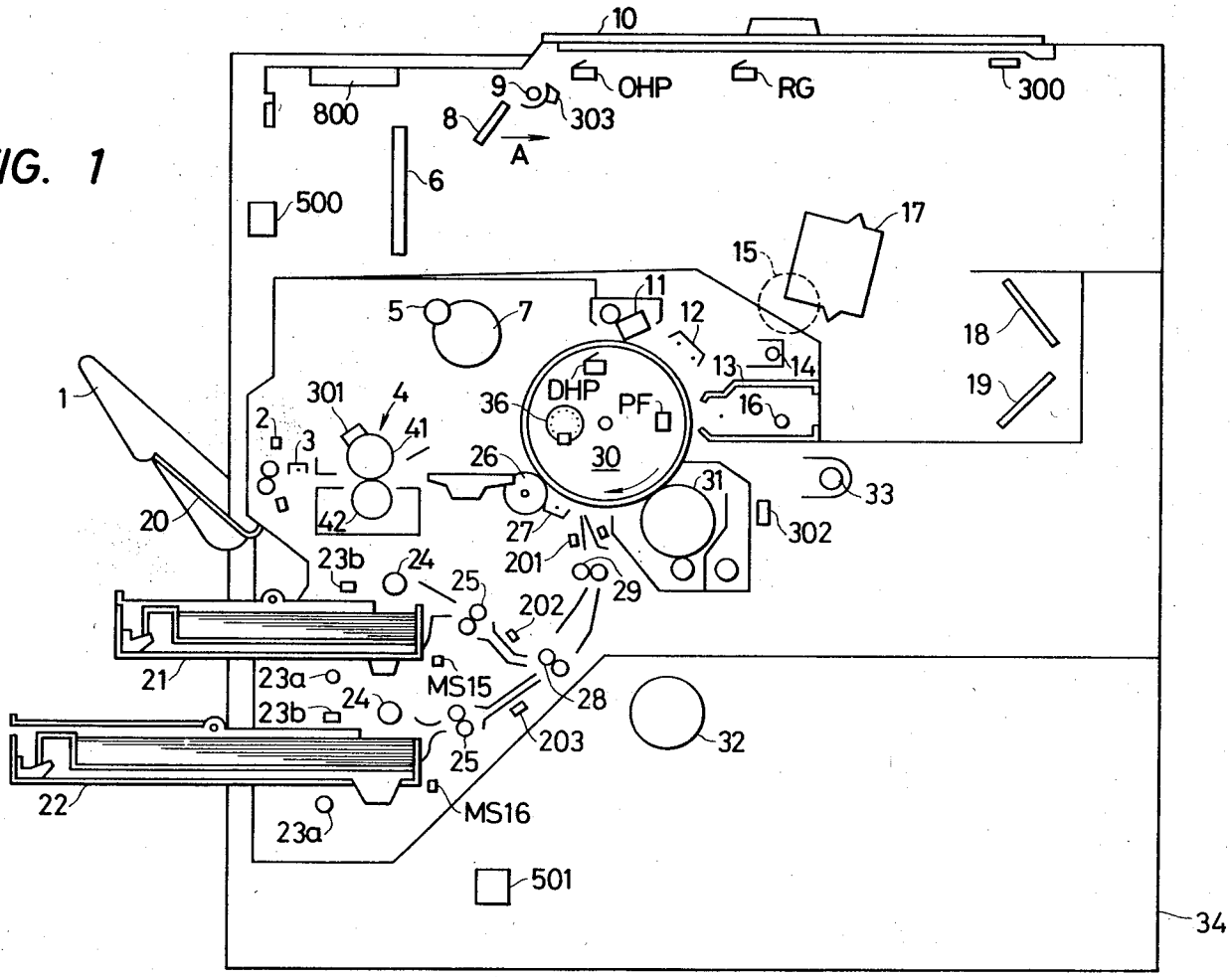
FIG. 1 is a schematic view showing an image recording system which employs a fixing apparatus according to the present invention.

FIG. 1 is a cross-sectional view of a copying apparatus to which the present invention is applicable. An original is placed on an original carriage forming an original supporting surface, and is held down by an original keep plate 10. An optical system comprises an illuminating lamp 9, movable mirrors 8 and 6, a lens 17 and fixed mirrors 18 and 19. The light image passed through the optical system is projected upon a photosensitive drum 30.

First, there is a copy preparation wait time such as a drum rotation time from after the unshown main switch of the copying apparatus is closed until the cleaning of the photosensitive drum is completed, or a wait time until a heat-fixing roller 4 rises to a certain standard temperature. When it is read into a microcomputer that said wait time has terminated and that a copy key for instructing the copy start, which will later be described, has been depressed, the following process sequence is started.

The operation of the FIG. 1 apparatus will be described after the closing of the main switch SW.

When the copy key is depressed, a main motor M1 is energized and the potential of the drum is made uniform for a predetermined time (one full revolution of the drum 30) and the cleaning of the drum is executed, whereafter the latent image formation sequence is entered. That is, the original is scanned by the movable mirror 8 moved with the illuminating lamp 9 in the direction of arrow A and the movable mirror 6 moved in the same direction at ½ of the movement velocity of the movable mirror 8 with the length of the light path maintained constant by these movable mirrors and is further slit-exposed via the lens 17 and fixed mirrors 18, 19 and imaged on the drum 30 having a photosensitive medium on the surface thereof. That is, the original is slit-exposed while being scanned by the optical system (illuminating portion). The surface of the drum 30 has a photosensitive medium comprising a photoconductive layer convered with a transparent insulating layer. The photosensitive medium is first charged to the positive polarity by a plus charger 12 supplied with a positive high-tension current from a high voltage source (not shown). Subsequently, when the photosensitive medium arrives at an exposure station 16, the original on the original carriage glass is illuminated by the illuminating lamp 9 and imaged on the drum 30 by the movable mirrors, the lens and the fixed mirrors and thus, the photosensitive medium is exposed to the image of the original while, at the same time, it is subjected to AC discharge by an AC discharger 13 which is supplied with an AC high-tension current from a high voltage source.

Subsequently, the photosensitive medium is subjected to the whole surface exposure by an all surface exposure lamp 33, whereby an electrostatic latent image is formed on the drum surface (photosensitive medium), whereafter the drum enters a developing device 31.

The electrostatic latent image is developed into a visible image by the developing device 31 which adopts the sleeve type powder development system.

A sheet of transfer medium is then fed from a cassette 21 or 22 by a paper feed roller 24 and conveyed by first rollers 25 and second rollers 28 and temporarily stopped by timing rollers 29, which are thereafter rotated by a registration signal RG to convey the paper again and thus, the leading end of the paper comes into registry with the leading end of the developed image. The registration signal may be provided by a switch RG which detects a particular passage position of the optical system. A switch OHP produces a signal indicative of the optical system home position (stop position). Both of these switches are actuated by a cam provided on the optical system (mirror 8).

The transfer medium so conveyed is brought into intimate contact with the drum, so that the image on the drum is transferred to the transfer medium by a transfer charger 27 with the aid of the positive high-tension current from a high voltage source.

After the image transfer has been terminated, the transfer medium is separated from the drum by a separating roller 26 and directed to a heat-fixing roller 4 for fixation of the transferred image, whereafter any excess charge on the transfer medium is removed by a discharger 3 and the transfer medium is discharged into a tray 20 by discharge rollers. This completes a cycle of copying. On the other hand, the drum surface (photosensitive medium) is cleaned by a blade 11 urged thereagainst to remove any toner remaining on the drum, thus becoming ready for another cycle of copying. The above-described cycle may be repeated by entering and presetting a desired numher of such copy process operations as described above with the aid of a numeric key (ten-key) on a keyboard which will hereinafter be described.

Switch PF is actuated to produce a paper feed signal by a cam provided on the drum. Switch DHP is actuated to produce a drum home position (stop position) signal by the drum cam and stop the drum at a position whereat the seam of the photosensitive medium bears against the cleaner 11. Reference characters 23*a* and 23*b* designate a lamp for detecting the presence of paper in the cassette and a light-receiving element for receiving the light from the lamp, and reference numeral 2 denotes a paper detecting lamp and associated light-receiving element for detecting the delay of paper and the stagnation of paper thereat. Designated by 16 is a blank exposure lamp which exposes the photosensitive medium when image exposure is not occurring, thereby eliminating irregularity of the surface potential of the photosensitive medium. Reference numeral 7 designates a motor for rotating the fixing roller, reference numeral 15 denotes a motor for moving the optical system backwardly, and reference numeral 14 designates, a pre-exposure lamp for prefatiguing and rendering uniform the photosensitive medium before the process. Designated by 36 is a pulse generator comprising a plate rotatable in response to the drum and an optical detector for detecting the aperature in the plate.

There are arranged three microswitches MS15 and three microswitches MS16 for detecting the presence and size of the cassettes. When none of these switches is in ON position, size discrimination is effected by a CPU, to be described, depending on the combination of the ON positions of the switches and the discriminated size of a selected upper or lower cassette is indicated by LED.

Designated by 302 is a search coil for detecting the amount of developing toner by detection of the $\mu$ variation resulting from any level change and for putting out a signal indicative of no toner.

Denoted by 301 is a thermistor for detecting the temperature of the fixing roller 4. When it detects an over-temperature, it reduces the power supply to the heater within the roller 4 to one-half. Designated by 300 is a thermistor for detecting the temperature of the platen glass on which the original is supported. It detects an over-temperature and interrupts the sequence in the same manner as when the absence of paper is detected. Reference numeral 303 designates a temperature fuse for detecting the over-temperature of the lamp 9 and cutting off the power supply to the lamp. Wait-up is also indicated by this thermistor.

Denoted by 201, 202 and 203 are microswitches for detecting a sheet. When they detect no sheet at their respective points within a predetermined time after paper feed, it is judged as a jam by the CPU to be described, and in the case of the microswitch 201, simultaneously with the detection of the jam, the power supply to the fixing heater H and the primary and secondary transfer DC chargers is stopped and the power supply to a drum motor $M_1$ and AC charger is stopped with a delay corresponding to one revolution. Thereby, the normal sheet after the image transfer station can be discharged. In the case of jam detection by the microswitch 202 or 203, it is judged as erroneous feeding from the cassette and the sequence is interrupted in the same manner as in the case of no paper. In the event of a jam at the discharge station 2, all the power supplies are quickly stopped to prevent the accident from being increased.

Figure 2:
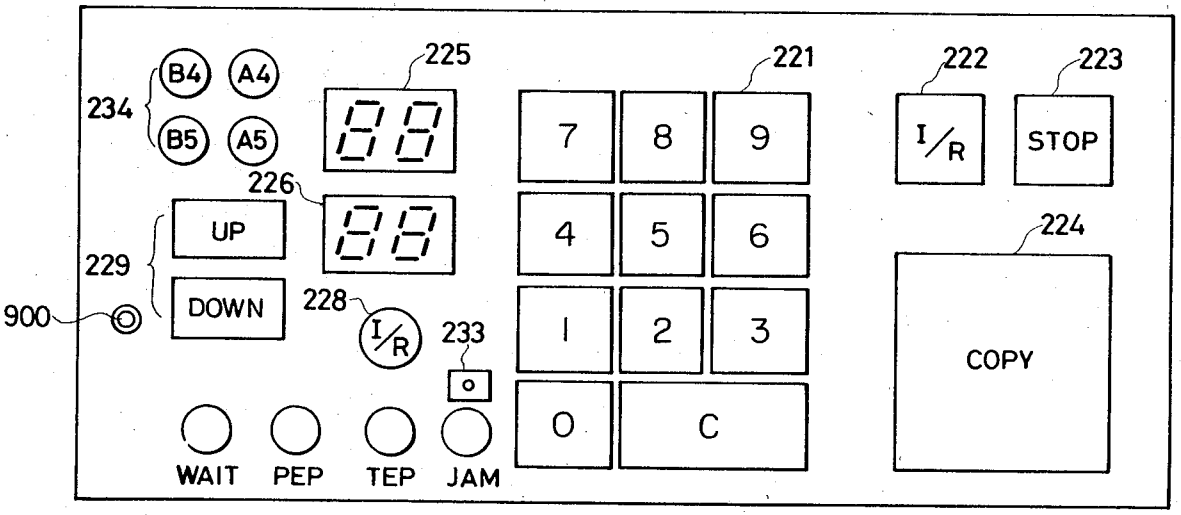
FIG. 2 is a plan view of an operation panel of the system shown in FIG. 1.

FIG. 2 shows the operating portion of this copying apparatus. The operator can set a desired number of copies up to a maximum 99 on an indicator 225 by depressing any one of numeric keys 221 from 0 to 9. When the main switch is closed, "1" is indicated on the indicator 225 and if a sheet of copy is desired, the operator need not depress any numeric key.

"CLEAR" key may be used when the set content of the indicator 225 is to be rendered to 1. "COPY" key 224 is for effecting the copying by the desired value indicated on the indicator 225 and, once this key is depressed, the machine enters a copying operation and when the optical system has arrived at its reverting position, the value on an indicator 226 is incremented from 0. At a point of time whereat the set value on the indicator 225 agrees with the value on the indicator 226 which indicates the number of copied sheets, the copying operation mode becomes a post rotation end mode (post) and, at a point of time whereat the copying operation terminates with the photosensitive drum stopped, the indicator 226 is reset to "0". Accordingly, the value initially set by a key still remains on the indicator 225 and therefore, when it is desired to produce the same number of copies of another original, the "COPY" key may be depressed again. During copying operation, when "STOP" key 223 is depressed at a point of time whereat the counted number has not yet reached the set value, or when one of indicators (PEP, 228) and LED (FIG. 12) is turned on, the copying operation for one sheet at that point of time is terminated to terminate the process cycle. Accordingly, for example, if said condition is brought about in the case of a counted value "3" for a set value "6", the indicator 225 will be stationary at "6" and the indicator 226 at "3". When all the stop conditions are released, operation can be started directly from that condition by the "COPY" key. Such interruption copying can be effected by the use of "I/R" key 222. If, when the copying by a first operator is at a set value "6" and a counted value "3" a second operator wants to produce two interruption copies, the second operator may depress the "I/R" key 222, retract the set value "6" and the counted value "3" of the indicators 225 and 226 into another memory, cause the indicators 225 and 226 to indicate "1" and "0", respectively, and turn on an I/R lamp 228. When one interruption copy is desired, if the "COPY" key is depressed, there will be obtained a sheet of copy. When two interruption copies are desired, "2" may be entered as the set number by a numeric key, whereafter the "COPY" key may be depressed, whereby two copies may be completed. After termination of this copying, the values "6" and "3" for the first operator are automatically called back to the indicators 225 and 226, respectively, so that the first operator may again depress the "COPY" key to obtain the remaining three copies.

Indication lamp 228 "I/R" is turned on upon depression of the "I/R" key and is turned off when interruption copying is terminated or interrupted.

The "STOP" key, when depressed after the interruption copying instruction, can release the interruption with the number of sheets.

Reference numeral 232 denotes a key for selecting an operating only LED indicators JAM, TEP and WAIT. Warning indication may be effected by both of these keys if no other key is depressed.

Indicator JAM may be turned on upon detection of the jam and cause the copying to shift to a termination mode in accordance with the place whereat the jam has been detected, as previously described.

The indication of "TEP" is turned on by a sensor 302 when the toner in the developing device has become exhausted, and it does not affect the staring or continuation of copying.

"PEP" is turned on when paper has become exhausted in a selected cassette, thereby inhibiting the starting of copying or terminating the continuation of copying.

"WAIT" is turned on for a time until the temperature of the fixing device reaches a predetermined value, thereby inhibiting the starting of copying, but once that temperature is reached "WAIT" renders the starting of copying (exposure) possible and holds that possible condition. This wait up (terminating the wait period) is detected and effected by a temperature senor 301.

Reference numeral 229 designates a switch for selecting the upper cassette or the lower cassette, and reference numeral 234 denotes an indicator for indicating the size of the selected cassette.

When a trouble has been detected before the copy sequence, the warning of no cassette, no paper or no toner is given during the closing of the main switch and during the depression of the copy key.

When the temperature rise of a process load such as a lamp or the like is detected by 300, 301 or 303, the set number indicator 225 is changed over from the so far indicated value to an error indication E1, E2 or E3 in response to the detecting sensor.

Figure 3:
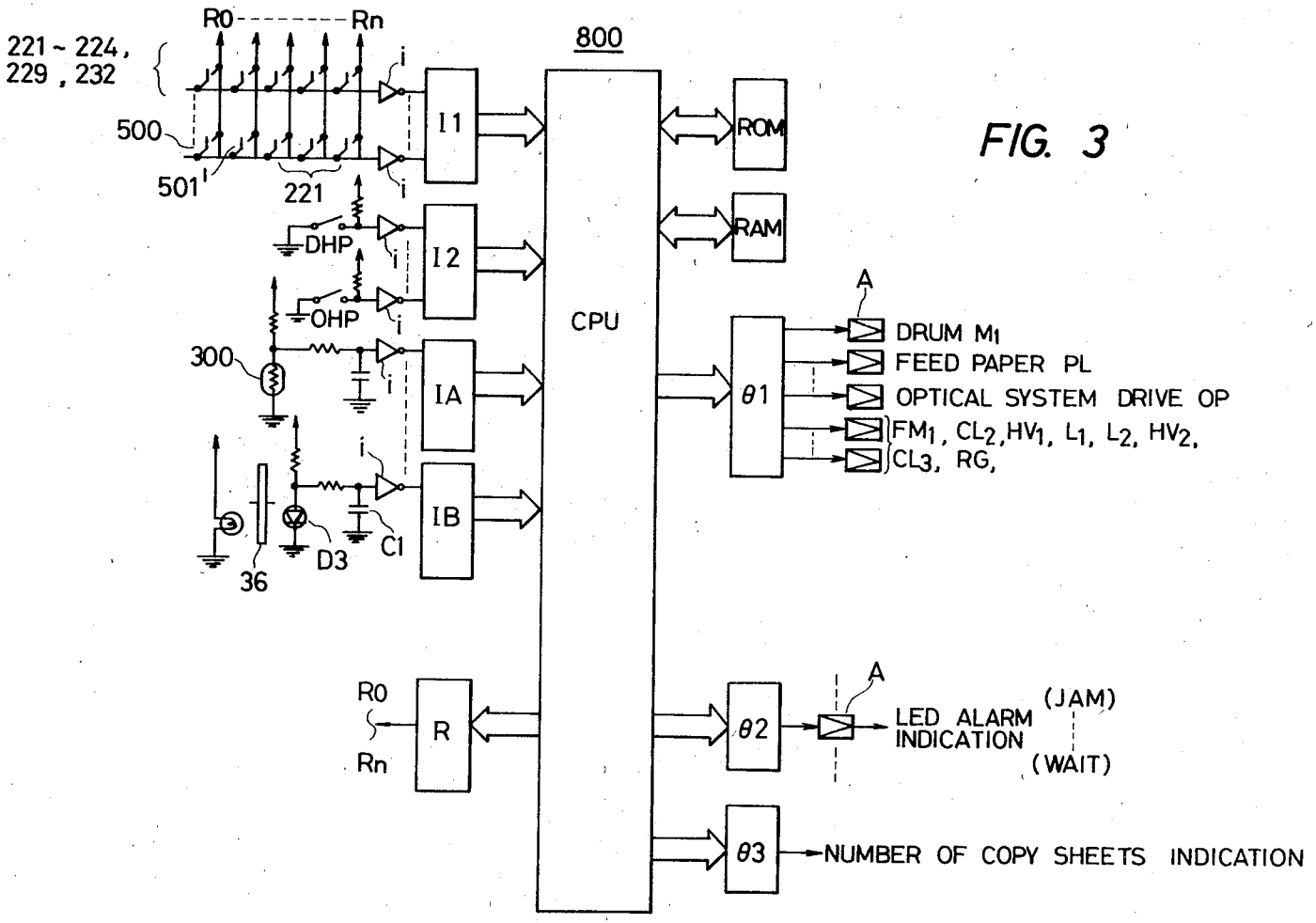
FIG. 3 is a block diagram of a control circuit of the system shown FIG. 1.

FIG. 3 shows a control circuit for executing the above-described operation. In FIG. 3, $M_1$ is a motor drive signal for rotating the photosensitive drum 30, $FM_1$ designates a fan motor for cooling the interior of the machine, PL is a solenoid ON signal for lowering the paper feed roller 24, $CL_2$ is a clutch signal for rotating the first register rollers 25, OP designates a clutch for forwardly moving the optical system 6, 8, 9, $HV_1$ is a power source ON signal for imparting a high voltage to the primary charger 12, $L_1$ is a signal for turning on the whole surface exposure lamp 33, $L_2$ is a signal for turning on the exposure lamp, BL is a signal for turning on the blank lamp, $HV_2$ is a power source ON signal for imparting a high voltage to the secondary charger 13, $CL_3$ is a clutch signal for rotating the second register rollers 29, RG is a signal for taking the second register rollers ON timing which is provided by a switch actuated by a cam provided on the optical system, and OHP is an optical system stop signal provided by a similar optical system cam switch.

In FIG. 3, a well-known microcomputer is employed as a central processing unit 800. ROM is a memory containing therein a program for executing the process sequence and indication. The program is stored in the ROM in the microprogram fashion using binary-coded instruction words.

RAM designates a data memory containing therein necessary data for the execution of said program and data including key input signals such as the set number of copies and detection input signals such as the number of copies produced; $I_1$ and $I_2$ denote input ports for inputting key signals and detection signals to the CPU; $D_1$ and $R_1$ designate output ports for latching the output signal from the CPU; IA denotes a high priority interruption input port; and IB designates a low priority interruption input port. An abnormality detection signal is input to IA, and a clock pulse for sequence timing is input to IB.

The CPU is a processing unit having the function of an accumulator ACC which temporarily contains therein the data from each input port and the data to each output port, the function of a decoder which decodes the codes of the ROM, and the function of ALU which operates and logically judges the data from the ROM, RAM, input and output ports. MCOM 44, 45, etc. produced by Nichidensha Co., Ltd. are available as the microcomputer 800.

Input data are input and processed in accordance with the execution of the program of the ROM, and introduced into ACC by a particular step and logically judged. The processing of the CPU proceeds to the next step, where it effects the control of copying operation load, the indication of warnings and the indication of numerical values.

IB is connected to $C_1$ and inverter i which waveform-shape the pulse output of a clock signal generating light-receiving element $D_3$, and IA is connected to $C_1$ and i which waveform-shape the output of a trouble detecting circuit constituted by the aforementioned sensors 300, 301, 303, **23*b*, etc. or an operational amplifier OA provided by these sensors. All key input means such as copy key 224, LED key, etc. are connected as switches at the matrix intersections between a strobe signal line and the input port lines of input port $I_1$ so as to be input in the dynamic scan fashion. Microswitches for generating copy sequence timing signals such as DHP, PF, OHP, RG, etc. and switches 2, 201–203, MS15 and MS16** for detecting jam are connected to the port lines of input port $I_2$. Stop position signals DHP and OHP are not connected to interruption ports IA and IB and therefore, a condition in which interruption is applied to the machine to render it inoperative can always be prevented simply.

The port lines of output port $\theta_1$ are connected through a drive amplifier a to the drum motor $M_1$, paper feed plunger PL, etc. which are process sequence loads.

LED is connected to each line of $\theta_2$ to turn on and off alarm indication LED (JAM, etc.), and 7-segment indicators 225 and 226 are connected to $\theta_3$ so that column selection pulse and segment pulse are put out.

Operation will now be described.

When the main switch SW is closed, whether or not the optical system is in its stop position OHP is discriminated and if it is not in such position, OP is turned on to return the optical system to said position. If the optical system fails to return within a predetermined time, OP is turned off and an error indication is effected to give an oral warning. Subsequently, indicators 25 and 26 are caused to indicate 01 and 00, which are stored by the RAM.

The ON condition of the COPY key and numeric keys is scanned by the time-division signal from output ports $R_o$–$R_n$ and dynamically input to the input port $I_1$. The computer reads that input signal and drives the drum motor $M_1$. As the drum is rotated, an intermittent light signal is generated by a disc 36 rotated in response to the drum motor and such signal is detected by a light-receiving element $D_3$, which thus generates drum clock pulses. When DHP signal is generated by an optical detecting switch at the drum home position, 250 drum clock pulses CP for which paper feed plunger PL is energized start to be counted. That is, by the inputting of the DHP ON signal to input port I2, the reception of the drum clock pulses to the interruption port IB is started. When a predetermined number of drum clock pulses is counted, a drive signal is put out from the output port $\theta_1$ to energize the paper feed plunger PL, which thus lowers the normally rotating paper feed roller to start paper feeding. After 50 clock pulses, the plunger PL is deenergized and from the next DHP signal, 100 clock pulses are counted and, in the same manner as described above, the optical system driving plunger OP is energized to move the optical system and at the same time, exposure is started. The deenergization of those instruments and the operation of other instruments which require timing are controlled in a similar manner. If the optical system fails to return to DHP within a predetermined time after the start thereof, optical system error indication.

The fixing apparatus of the present invention will be described with reference to FIGS. 4 to 6.

Figure 4:
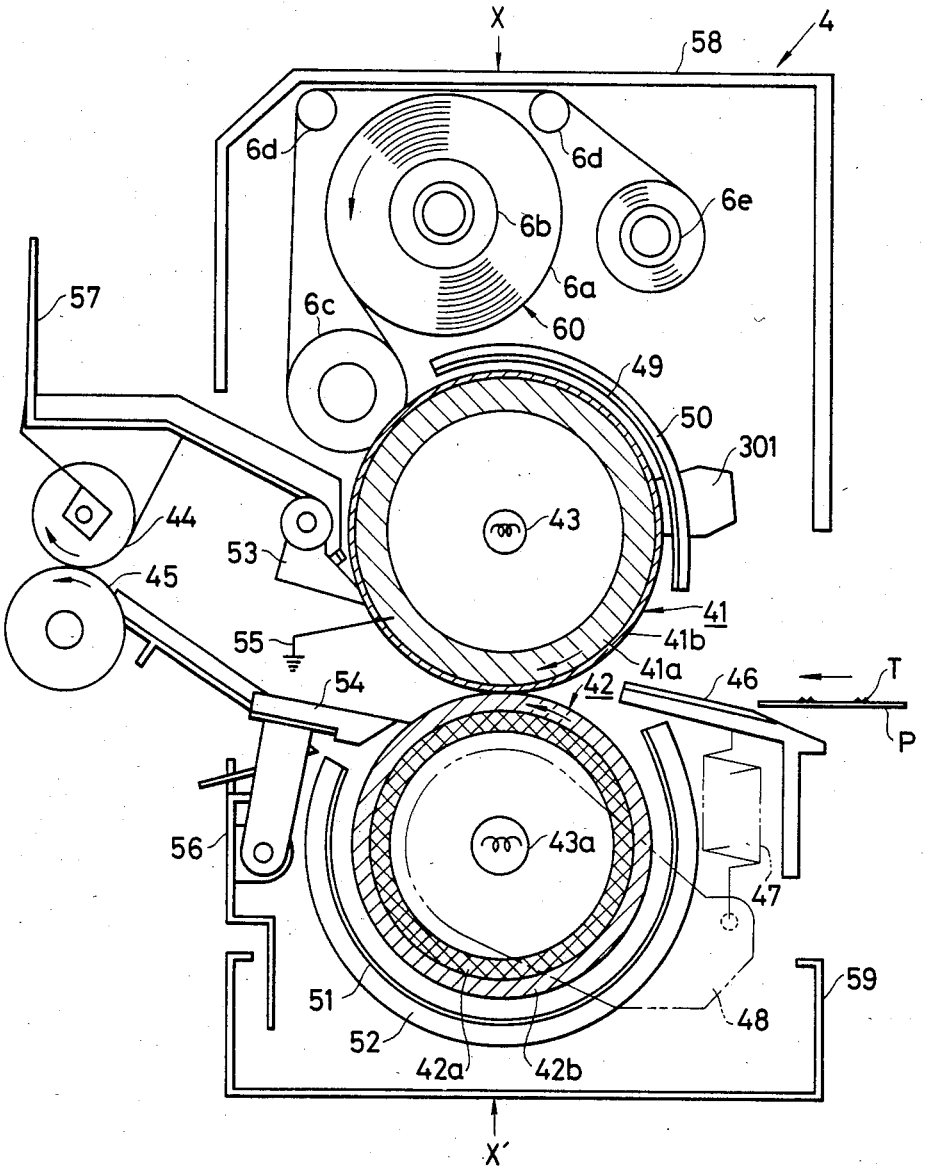
FIG. 4 is an enlarged view schematically showing the fixing apparatus 4 shown in FIG. 4.

FIG. 4 shows the fixing apparatus according to an embodiment of the present invention. The fixing apparatus comprises a heating roller fixing apparatus for fixing a toner image T formed by electrophotography on a normal paper sheet P.

A heating roller 41 has a heater 43 such as a halogen heater and is brought into contact with the nonfixed tone image T. The heating roller 41 is driven by a drive motor to be described later and is rotated in a direction indicated in FIG. 4. A pressure roller 42 includes therein a low-temperature heater **43*a*. The pressure roller 42 is in rolling contact with the heating roller 41. The heating roller 41 comprises a metal hollow roller core 41*a* made of aluminum, stainless steel or copper and a heat-resistant resin layer 41*b* which is made of one of polytetrafluoroethylene (PTEE) and perfluoroalkoxy (PFA) or one of silicone rubber, fluorine rubber, fluorosilicone rubber and the like. The layer 41*b* is formed on the outer surface of the roller core 41*a*. The metal hollow roller core 41*a* as the base of the heating roller 41 is grounded through a grounding means (55, 65**) such a brush or the like to be described later.

The pressure roller 42 is rotatably supported by a bearing to be described later. The pressure roller 42 is brought into contact with the heating roller 41 by a pressure means at least when fixing is performed. A relatively thick elastic layer 42*b* made of silicone rubber, fluorine rubber, fluorosilicone rubber, EPDM, or hydrine rubber is formed on the outer surface of a metal hollow roller core 42*a*.

A sensor or heat-sensitive element 301 such as a thermister or thermocouple is brought into contact with the outer surface of the heating roller 41. A detection signal from the heat-sensitive element 301 is supplied to a controlling means such as microcomputer 800 (located at the upper right position in FIG. 1) through a line. The temperature at the outer surface of the heating roller 41 is kept at a toner melting temperature by controlling an output from the heater 43 or an application voltage thereto. A noise component by spark and discharge may be supplied to the microcomputer 800 through the above-mentioned line. However, noise may be generated by high-voltage induction in the microcomputer 800.

A cleaning/offset preventing liquid applying member 60 serves to remove a foreign object such as an offset toner or paper dust from the surface of the heating roller 41. The member 60 is obtained by impregnating a heat-resistant web 6*a* of Nomex or Hyromen with an offset preventing liquid consisting of one of dimethyl silicone oil, methylphenyl silicone oil, fluorosilicone oil and amino-denatured silicone oil.

The cleaning web 6*a* is brought into contact with the heating roller 41 by an elastic press roller 6*c*. The web 6*a* is taken up from a supply roller 6*b* by a take-up roller 6*e* in such a manner the web 6*a* slightly changes its contact position. A new surface portion of the cleaning web 6*a* is always brought into contact with the heating roller 41. The web 6*a* is moved along rollers 6*d* arranged in a path after the press roller 6*c* and is inverted toward a side of the supply roller 6*b*. Therefore, the web 6*a* is wound such that a lower surface of the web 6*a* is brought into contact with the take-up roller 6*e*.

An arcuated reflecting plate 49 has a thermal reflectivity. The reflecting plate 49 is arranged in the vicinity of the heating roller 41 and extends along the entire length of the heating roller 41. The reflecting plate 49 has a width to cover an outer surface portion of the heating roller 41 between the position of the press roller 6*c* and the insertion opening of the sheet P. A cover 50 prevents heat radiation. The cover 50 is in tight contact with the convex surface of the reflecting plate 49 so as to prevent wasteful heat radiation from the reflecting plate 49. An upper casing member 58 of the fixing apparatus surrounds the cleaning member 60, the reflecting plate 49, the cover 50 and the heat-sensitive element 301. The temperature detection section of the heat-sensitive element 301 is located nearer to the roller 41 than to the reflecting plate 49.

A reflecting plate 51 and a cover 52 which are respectively the same as the reflecting plate 49 and the cover 50 are arranged on the side of the pressure roller 42 so as to surround most of the pressure roller 42.

In this manner, the reflecting plates 49 and 51 and the covers 50 and 52 are provided to prevent wasteful radiation of heat from the heating and pressure rollers. At the same time, the measuring characteristics of the heat-sensitive element 301 can be stabilized. The setting temperature of the heating roller 41 can be properly adjusted, and power consumption can be decreased.

A guide plate 46 guides the sheet P on the side of the heating roller 41 and is arranged in the vicinity of the heating roller 41 between one end of the reflecting plate 49 and one end of the reflecting plate 51. A support plate 48 supports the pressure roller 42, and the pressure roller 42 is brought into contact with the heating roller 41 by a spring 47.

The sheet P having a nonfixed toner image T is heated and clamped by the rollers 41 and 42 to fix the toner image T by heat from the rollers 41 and 42. The sheet P is discharged outside the image forming system while the sheet P is being clamped between discharge rollers 44 and 45. A separation pawl 53 is arranged at the discharge port portion along the axis of the heating roller 41 and is in contact with the surface of the roller 41 so as to properly separate the sheet P from the heating roller 41.

A separation pawl 54 is also provided at the discharge portion of the pressure roller side and is in contact with the pressure roller 42. The separation pawl 53 is held by a support plate 57 separated from a casing member 58. The separation pawl 54 is held by a support plate 56 separated from a lower casing member 59 of the fixing apparatus. The casing member 59 covers the plate 51 and the cover 52 at a distance therefrom.

Figure 5:
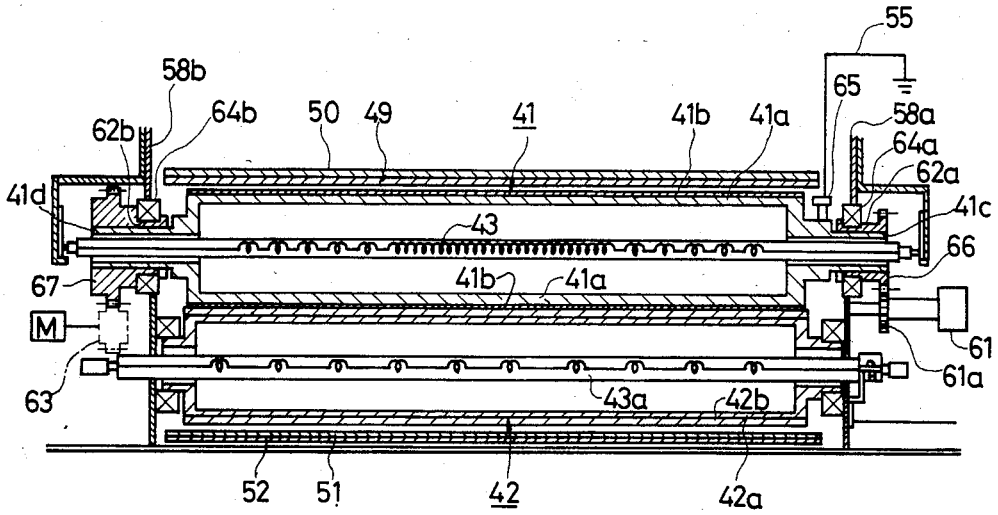
FIG. 5 is a sectional view of the fixing apparatus taken along the line X—X in FIG. 4.

The end mechanism of the heating roller 41 will be described in detail with reference to FIG. 5 showing the section of the fixing apparatus along the line X–X′ of FIG. 4.

Heat-resistant sleeves 62*a* and 62*b* are respectively mounted on rotating shafts 41*c* and 41*d* at two ends of the core 41*a* of the heating roller 41. The heat-resistant sleeves 62*a* and 62*b* are respectively in contact with bearings 64*a* and 64*b* mounted on side frames 58*a* and 58*b* of the casing member 58 of the fixing apparatus. Heat-resistant gears 66 and 67 are mounted on the rotating shafts 41*c* and 41*d* of the core 41*a* of the heating roller 41, respectively. The left heat-resistant gear 67 meshes with a drive transmission gear 63. The gear 67 receives the driving force from a driving source M and is rotated together with the heating roller 41. The right heat-resistant gear 66 meshes with a gear 61*a* of a manual knob 61 and receives a manual driving force.

The heat-resistant gears 66 and 67 comprise a heat-resistant material. Heat from the heating roller 41 will not be transferred to a drive transmission member such as any other gear through the gears 66 and 67. In addition, heat radiation from the gears themselves is also decreased. The gears 66 and 67 keep the heating roller 41 at a constant temperature.

The sleeves 62*a* and 62*b* are also made of a heat-resistant material. Heat transfer from the end portions of the heating roller 41 to the bearings 64*a* and 64*b* and the side frames 58*a* and 58*b* of the casing member 58 is prevented. The heat loss from the end portions of the heating roller 1 can be decreased by the heat-resistant gear 66 and 67, as compared with the heat loss of the conventional fixing apparatus. The addition of the heat-insulating sleeves 62*a* and 62*b* can greatly decrease the heat loss or can substantially eliminate the heat loss.

As described above, the heating roller 41 has the layer 41*b* made of an insulating resin or a mold release material such as a rubber material. This layer 41*b* constitutes the fixing surface. The surface of the web 6*a*, the thermister 301, the separation pawl 53 and the pressure roller 42 are in contact with the layer 41*b*. In addition, the gears 63 and 61*a* and the bearings 64*a* and 64*b* which are associated with rotation of the heating roller 41 are brought into rolling contact through the insulating material. More particularly, when the member of a discharge brush 65 is removed, the core 41*a* as the base is in contact with the associated members through the insulating material, so that the heating roller 41 is completely kept in the thermally floating state.

The wasteful heat loss caused by heat conduction is greatly decreased, so that heat from the heater 43 is effectively transferred to the surface of the fixing roller. In addition, the charge on the layer 41*b* is not abruptly but gradually grounded through the core 41*a* so as to prevent overcharging, thereby preventing the disturbance of the fixed image. The spark and discharge phenomenon can be prevened, and an abrupt current flow in the control circuit such as a microcomputer will not occur. Therefore, an image forming failure and image disturbance which are caused by an erroneous operation of the control circuit can be prevented. In other words, the good fixing property and clearness of the stable fixed image can be maintained for a long period of time.

In general, the heat-resistant gears 66 and 67 are interlocked with other various drive transmission members. The heat loss of the conventional fixing apparatus is mainly caused by these other various drive transmission members. However, according to this embodiment, the heat loss by these drive transmission members can be decreased or substantially eliminated, thereby greatly improving the thermal efficiency and decreasing power consumption. In the above embodiment, the heat-resistant sleeves 62*a* and 62*b* are used in addition to the heat-resistant gears 66 and 67. The heat loss from the end portion of the roller to the frames 58*a* and 58*b* can be prevented to further improve the thermal efficiency. In the above embodiment, the heat-resistant members are mounted at two ends of the heating roller 41. However, only the heat-insulating member is provided between the portion of the driving force transmission member which is in rolling contact with the roller 41 and the roller 41. Each of the heat-resistant sleeves 62*a* and 62*b* comprises a heat-insulating material such as polyimide resin, polyamide-imide resin, polyamide resin, PPS (polyphenylene sulfide) resin, PBT (polybutylene terephthalate) resin or phenol resin, or a heat-insulating material made of a mixture thereof. Each of the gears 66 and 67 comprises a heat-resistant material such as polyimide, polyamide-imide, PSS, denatured phenol, a material obtained by adding a reinforcing filler in ethylene tetrafluoride.

The conductive discharge brush 65 is supported by a ground means (not shown; the brush 65 is grounded through a grounding means or conductive ground guide cable 55) at the end of the core 41*a* of the heating roller 1. The conductive brush 65 serves to provide an electrically grounded fixing apparatus even if the fixing apparatus of the above-mentioned roller configuration is set in the thermally floating state.

An electrostatic charge generated upon rotation of the heating roller 41 and the pressure roller 42 is discharged through the core 41*a* grounded by the conductive brush 65. Neither the heating roller 41 nor the pressure roller 42 will be set at a high potential. As a result, an arc discharge will not occur.

Furthermore, since the toner is not in contact with the surface of the offset heating roller 41 but with the core 41*a*, electrical contact between the conductive brush 65 and the core 41*a* of the heating roller 41 is maintained even if the fixing apparatus is frequently used. The fixing apparatus and the heating roller 41 are always grounded. As a result, an arc discharge will not occur at the time of fixing, thereby providing stable fixing without image degradation.

As described above, the heating roller 41 is thermally isolated by the heat-resistant sleeves 62*a* and 62*b* an the heat-resistant gears 66 and 67 from the image forming system housing and the frames 58*a* and 58*b*, and is electrically floating except for the relationship with the discharge brush. The heat loss through the sleeves 62*a* and 62*b* and the gears 66 and 67 is very small. With this arrangement, the thermal efficiency becomes very high, and uniform fixing can be performed in the single sheet copy mode. However, when the image forming apparatus is set in the continuous copy mode, fixing at the central portion of the sheet becomes impaired in comparison with fixing at the peripheral portions of the sheet. This tendency becomes typical when a copy sheet number becomes 70 to 80.

There are two reasons for the above problem. First, the temperatures of the central portions of the heating and pressure rollers 41 and 42 are decreased since heat is transferred to the copy sheet. On the other hand, the heat transfer from the end portions of the rollers is smaller than that from the central portions. The temperatures at the end portions of the heating and pressure rollers 41 and 42 are higher than those at the central portions thereof. Second, the exothermic quantity received from end portion of the heating roller 41 to the corresponding end portion of the pressure roller 42 is larger than that from the central portion of the heating roller 41 to the central portion of the pressure roller 42. Therefore, the end portion of each roller is thermally expanded in a reverse crown shape, and a contact pressure between the opposing end portions of the heating and pressure rollers 41 and 42 becomes higher than that between the central portion thereof.

The exothermic quantity at the central portion of the heater 43 in the heating roller 41 is preferably larger than at the end portion thereof. In addition, the heating length of the heater 43 is preferably equal to or shorter than the largest paper width.

Figure 6:
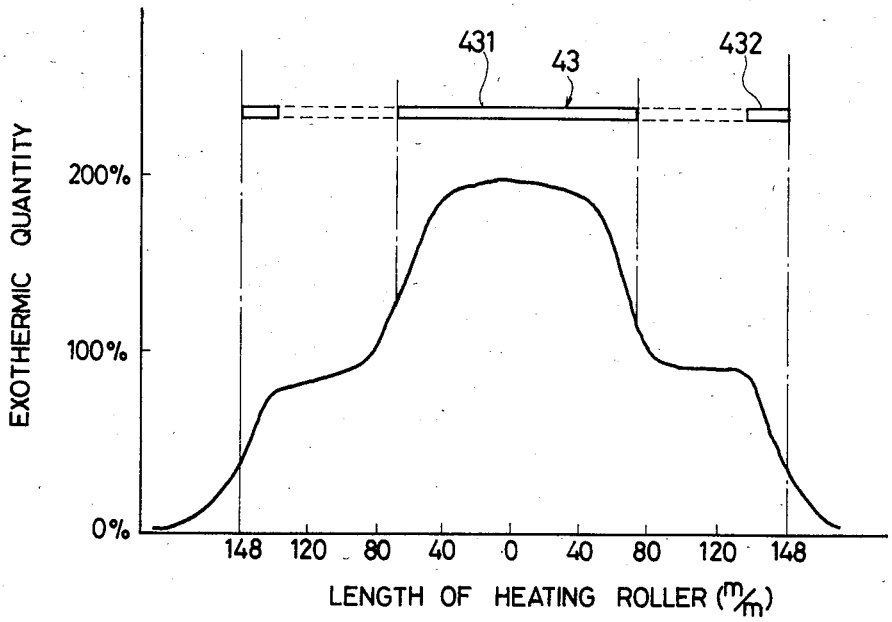
FIG. 6 is a graph showing the exothermic quantity profile of a heater 43 of the fixing apparatus in FIG. 1.

FIG. 6 shows the relationship between the exothermic quantity and the length of the heating roller 41 when the heater 43 in the heating roller 41 has a heating length which is substantially the same as a length of general copying paper of 297 mm. In this manner, when the heater 43 having a maximum temperature profile at the center thereof is used, the exothermic quantity at a central portion 431 of the heater 43 becomes twice that at an end portion 432. However, in the standby mode, the temperature of the surface of the roller along its longitudinal direction becomes uniform. In other words, in the standby mode, the temperature at the central portion of the heating roller 41 will not be decreased due to the pressure of this heater 43 even if sheets continuously pass through the heating roller 41 and the pressure roller 42. In this manner, the toner image T can be stably fixed on the sheet P with a substantially uniform temperature profile, thereby constantly obtaining a good image quality Even if continuous copy operation is performed, the exothermic quantity at the central portion 431 of the heater 43 is larger than any other portion thereof, as shown in FIG. 6. A great amount of heat transfer from the central portion of the heating roller to the sheets continuously fed can be compensated, and a decrease in temperature at the central portion of the heating roller 41 will not occur. As a result, stable fixing with good image quality can be performed by the fixing apparatus of this embodiment.

As has been described above, in order to prevent heat loss at the end portions of the fixing rotating member heated by a heating source, the fixing apparatus is set in the thermally floating state (preferably, an excessive decrease in exothermal quantity of the central portion of the fixing rotating member in the continuous copy mode is compensated by changing a temperature profile of the heating source). In addition, since the fixing apparatus which is set in the thermally floating state is also set in an electrically floating state, the core of the heating roller is grounded through the electrical brush. Therefore, stable fixing with good image quality can be performed even in the continuous copy mode. The roller will not be charged at a high potential, thereby preventing "local scattering" of the image and causing the fixing apparatus to perform stable fixing operation.

In the above embodiment, one of the heating and pressure rollers is used to exemplify the feature of the present invention. However, the present invention can also be applied to a two-roller fixing system, two-belt system or a system using three or more rollers.

In the above embodiment, the discharge brush is used as the grounding means and a conductive wire, stylus or roller may be used as a contact grounding means. The grounding means preferably has a discharge member with a flexible contact portion.

An electrical discharger using a diode or a discharger such as a conductive brush located in the vicinity of the core in a noncontact manner may be used as the grounding means so as to obtain the same effect as the grounding means of the above embodiment without disturbing the toner image or the like.

The heating roller 41 as the first rotating member in the above embodiment is brought into direct contact with the toner image, and is the most preferable example of the present invention. However, the first rotating member may comprise the pressure roller 42. Alternatively, two rollers may serve as the first rotating member. The first rotating member preferably has an outer surface with a releasing property of the toner image or the like, or a heat-resistant insulating layer such as a resin layer. The insulating layer preferably has a volume resistivity of $10^6$ Ω.cm or more. When the resistivity is less than $10^6$ Ω.cm, the charged surface of the support member which opposes a toner carrying surface is discharged through the roller. As a result, the toner distribution is disturbed along the leading end of the support member resulting in "leading edge disturbance" of the image.

The relatively thin layer **41*b* of the roller 41 has a thickness of 0.05 to 2 mm. Since this layer 41*b*** is sufficiently thin, the ground effect of the core as the base can be sufficiently obtained. Therefore, high-speed fixing is performed in the continuous copy mode.

According to the present invention, a good heating-/fixing performance can be provided for a long period of time. In addition, the toner or the like will not scatter from the sheet after fixing is performed, and thus a clear fixed image can be obtained.

The fixing apparatus according to the present invention is far better than the conventional fixing apparatus.

What is claimed is:

1. A fixing apparatus for fixing an unfixed material on a recording medium, comprising:

first and second rotating members for pressing and conveying the recording medium and fixing the unfixed material on the recording medium, said first rotating member having a thermally conductive base and a heat-resistant, electrically and thermally insulating surface layer formed on an outer surface of said thermally conductive base, said second rotating member having a heat-resistant insulating surface layer, said first rotating member being brought into contact with said second rotating member with said surface layers thereof facing each other;

heating means for heating said first rotating member;

means for bringing said first rotating member into pressure contact with said second rotating member;

means for transmitting a driving force for rotating said first rotating member;

a frame member for rotatably supporting said first rotating member;

heat insulating means provided between the thermally conductive base of said first rotating member and said frame member and between the thermally conductive base of said first rotating member and said transmitting means; and means for electrically grounding said thermally conductive base of said first rotating member.

2. A fixing apparatus according to claim 1, wherein said grounding means comprises a conductive member with a flexible abutment portion brought into contact with said thermally conductive base of said first rotating member.

3. A fixing apparatus according to claim 1, wherein said fixing apparatus is controlled by controlling means which controls the image formation by an image forming apparatus to which said fixing apparatus is applied and said grounding means prevents electrical noise such that the electrical noise generated from said first and second rotating members is not supplied to a control circuit of said controlling means.

4. A fixing apparatus according to claim 1, wherein said fixing apparatus has supporting means to rotatably support said first rotating member to said frame member; said heat insulating means has a heat insulating member at a position wherein said first rotating member is supported by said supporting means, and a heat insulating gear at a position where said first rotating member is connected to said transmitting means.

5. A fixing apparatus according to claim 4, wherein said heat insulating gear is a resin gear.

6. A fixing apparatus according to claim 1, wherein heat-resistant, electrically and thermally insulating surface layer of said first rotating member comprises a releasable surface layer with a volume resistivity of not less than $10^6$ Ω.cm.

7. A fixing apparatus according to claim 1, wherein said transmitting means comprises first transmitting means for transmitting a drive force from a drive motor and second transmitting means for transmitting a manual drive force, said first transmitting means being connected to one end of said first rotating member and said second transmitting means being connected to the other end of said first rotating member.

8. A fixing apparatus according to claim 1, wherein said first rotating member directly contacts with said unfixed material, and said heating means is provided inside of said first rotating member.

9. A fixing apparatus according to claim 8, wherein said heating means comprises a heater having a greater output at a central region than an end region thereof with respect to an axial direction of said first rotating member.

10. A fixing apparatus according to claim 1, wherein said heat-resistant, electrically and thermally insulating surface layer of said first rotating member comprises a releasable surface layer with a relatively small thickness falling within a range of 0.05 to 2 mm.

11. A fixing apparatus for fixing an unfixed material on a recording medium, comprising:

first and second rotating members for pressing and conveying the recording medium and fixing the unfixed material on the recording medium, said first rotating member having a thermally conductive base and a heat-resistant, electrically and thermally insulating surface layer formed on an outer surface of said thermally conductive base, said second rotating member having a heat-resistant insulating surface layer, said first rotating member being brought into contact with said second rotating member with said surface layers thereof facing each other;

heating means for heating said first rotating member;

means for bringing said first rotating member into pressure contact with said second rotating member;

means for transmitting a driving force for rotating said first rotating member;

a frame member for rotatably supporting said first rotating member;

heat insulating means preventing heat loss due to heat transmission from said first rotating member to said transmitting means and to said frame member; and means for electrically grounding said thermally conductive base of said first rotating member.

12. A fixing apparatus according to claim 11, wherein said heat insulating means has a heat insulating gear at a position where said first rotating member is connected to said transmitting means.

13. A fixing apparatus according to claim 11 or 12, wherein said heat insulating means has a heat insulating member at a position where said first rotating member is supported by said frame member.

14. A fixing apparatus according to claim 11, wherein said grounding means comprises a conductive member with a flexible abutment portion brought into contact with said thermally conductive base of said first rotating member.

15. A fixing apparatus according to claim 11, wherein said fixing apparatus is controlled by controlling means which controls the image formation by an image forming apparatus to which said fixing apparatus is applied and said grounding means prevents electrical noise such that the electrical noise generated from said first and second rotating members is not supplied to a control circuit of said controlling means.

16. A fixing apparatus according to claim 11, wherein said transmitting means comprises first transmitting means for transmitting a drive force from a drive motor and second transmitting means for transmitting a manual drive force, said first transmitting means being connected to one end of said first rotating member and said second transmitting means being connected to the other end of said first rotating member.

17. A fixing apparatus according to claim 11, wherein said first rotating member directly contacts with said unfixed material, and said heating means is provided inside of said first rotating member.

18. A fixing apparatus according to claim 17, wherein said heating means comprises a heater having a greater output at a central region than an end region thereof with respect to an axial direction of said first rotating member.

19. A fixing apparatus according to claim 11, wherein heat-resistant, electrically and thermally insulating surface layer of said first rotating member comprises a releasable surface layer with a volume resistivity of not less than $10^6$ Ω.cm.

20. A fixing apparatus according to claim 11, wherein said heat-resistant, electrically and thermally insulating surface layer of said first rotating member comprises a releasable surface layer with a relatively small thickness falling with a range of 0.05 to 2 mm.

21. A fixing apparatus according to claim 12, wherein said heat insulating gear is a resin gear.

* * * * *